US007011260B2

(12) United States Patent
Ozawa

(10) Patent No.: US 7,011,260 B2
(45) Date of Patent: Mar. 14, 2006

(54) RAW GARBAGE TREATMENT APPARATUS AND A CUTTER THEREOF

(75) Inventor: Tetsuya Ozawa, Matsumoto (JP)

(73) Assignee: Izumi Products Company, Nagano (JP)

( * ) Notice: Subject to any disclaimer, the term of this patent is extended or adjusted under 35 U.S.C. 154(b) by 115 days.

(21) Appl. No.: 10/813,341

(22) Filed: Mar. 30, 2004

(65) Prior Publication Data

US 2004/0251359 A1 Dec. 16, 2004

(30) Foreign Application Priority Data

Mar. 31, 2003 (JP) ..... 2003-095474

(51) Int. Cl.
*B02C 18/12* (2006.01)

(52) U.S. Cl. ..... 241/57; 241/65; 241/261

(58) Field of Classification Search ..... 241/188.1, 241/57, 65, 243, 261, 257.1
See application file for complete search history.

(56) References Cited

U.S. PATENT DOCUMENTS 1,977,955 A * 10/1934 Robinson ..... 241/259
3,593,930 A * 7/1971 Lautzenheiser ..... 241/188.1

FOREIGN PATENT DOCUMENTS

| | | |
|---|---|---|
| FR | 2597764 | 10/1987 |
| GB | 990889 | 5/1965 |
| JP | 59-162957 | 9/1984 |
| JP | 2001-113194 | 4/2001 |

* cited by examiner

*Primary Examiner*—Mark Rosenbaum
(74) *Attorney, Agent, or Firm*—Koda & Androlia

(57) ABSTRACT

A raw garbage treatment apparatus including a treatment tank 10, a rotating shaft 32 which rises in an upright attitude from the center of the bottom of the treatment tank, a motor 36 which rotates the rotating shaft from beneath the treatment tank, a plurality of rotating blades 58 which have cutting vanes 58A that extend outward with the rotating shaft as the center and which are provided on the rotating shaft at intervals from each other, a plurality of fixed blades 60 through which the rotating shaft rotatably passes and which form a main cutter A together with the rotating blades, and a supporting frame 38 which has vertical plates 40 that hold the outer end portions of the fixed blades and whose upper end is fastened to the upper portion of the inside of the treatment tank.

9 Claims, 8 Drawing Sheets

RAW GARBAGE TREATMENT APPARATUS AND A CUTTER THEREOF

BACKGROUND OF THE INVENTION

1. Field of the Invention

The present invention relates to a raw garbage treatment apparatus that treats to dispose raw garbage such as food waste, leftover food, etc. while reducing the volume of such garbage by cutting and pulverizing the garbage, and it also relates to a cutter used in such a raw garbage treatment apparatus.

2. Prior Art

Biodegradation type apparatuses and drying type apparatuses have been known in the past as raw garbage treatment apparatuses. In the biodegradation system, degradation of organic matter is caused by microorganisms (bio-organisms), and various treatment units of this type have been commercially marketed for general household use. The drying system dehydrates and dries raw garbage by heating and agitating the garbage without relying on microorganisms.

In the case of the biodegradation type system, apparatuses that have a slow degradation rate so that organic matter is slowly and naturally degraded by microorganisms in the natural world are insufficient for practical use, and it is necessary that a continuous degradation of daily raw garbage be done within the same day (within 24 hours). The performance of such an apparatus depends on the capacity of the bio-organisms themselves and on the maintenance of the interior of the treatment tank in an environment that allows efficient activity of the bio-organisms. Accordingly, in order to allow efficient activity of the bio-organisms, the temperature must be controlled (generally to around 60° C.), and appropriate moisture regulation and oxygen (air) supply are also necessary.

In one of the known biodegradation type apparatuses, an organism bed base material (generally called chips), which is porous and in which the regulation of moisture and supply of oxygen, etc. are suited to the activity of the bio-organisms, is employed, and independently developed special chips are used. In the treatment tank that contains the chips, a temperature control device that regulates the temperature to the optimal temperature for the activity of the bio-organisms, a simple-structured agitating apparatus, a fan that supplies oxygen (air), and a sensor of a moisture content monitor are, along with other component, provided. The raw garbage that is placed in the treatment tank is supplied with oxygen and mixed with the chips by being agitated.

In the case of the drying type treatment apparatus, the raw garbage is subjected to a dehydration and drying treatment by deliberately heating the garbage to a high temperature (to a temperature just prior to the point of carbonization). Accordingly, a heater and a simple agitating apparatus are indeed necessary. Furthermore, since the raw garbage is heated to a high temperature, a strong unpleasant odor is generated. Countermeasures such as air-tight sealing of the treatment tank or the installation of a deodorizing apparatus using a heating catalyst must be, therefore, taken against this odor problem, but this causes the apparatus to be complicated in structure.

Japanese Patent Application Laid-Open (Kokai) No. 59-162957 discloses such a drying type apparatus. In this treatment or disposing apparatus, screw vanes are attached to the lower part of a rotating shaft that rises from the bottom of the treatment tank, and a cutting mechanism, (cutter) which is formed by rotating blades fastened to the rotating shaft above these screw vanes and fixed blades fastened to the sides of the treatment tank, is provided. The raw garbage that is placed in the treatment tank from above is cut by the cutting mechanism, and the moisture is evaporated on the inside wall of the heated treatment tank. Meanwhile, the cut garbage that falls to the bottom is dried by being caused to contact the walls of the treatment tank while being scraped upward by the screw vanes. The cutter is considered to cut the garbage only once when the raw garbage is introduced.

In the apparatus of Japanese Patent Application Laid-Open (Kokai) No. 2001-113194, a rotating blade is fastened (in a position separated from the bottom) to a rotating shaft that rises from the bottom of the treatment tank, a fixed blade that forms a cutter as a pair with this rotating blade is fastened to the treatment tank, a scraping plate which is fastened to the rotating shaft is provided beneath this cutter. The raw garbage that drops from the cutter is scraped outward in the radial direction and is further scraped upward by a helical inclined plate.

In the case of a biodegradation type raw garbage treatment apparatus, even if the raw garbage consists of organic matter, there may be garbage that hinders the activity of the microorganisms or garbage that requires a long time for degradation, etc. Furthermore, there are also limits to the capacity of the bio-organisms. Accordingly, restrictions and regulations regarding the garbage that can be introduced are also described in the respective handling instructions of various types of raw garbage treatment apparatuses. For example, depending on the type and content of the garbage (e.g., in the case of hard root vegetable scraps, large leaf vegetable scraps, fruit peels, strong fibrous matter, etc.), it may be necessary to put in the garbage after the garbage has been chopped to a size of 3 to 5 cm or less beforehand in order to accelerate degradation. Furthermore, fermented food products, waste edible oils, tobacco, etc. hinder the activity of bio-organisms, while shellfish, the shells of large crustaceans and bones, etc. cannot be degraded in a short period of time, and inorganic material may become mixed in with the garbage. Thus, sufficient attention must be paid to such types of garbage.

Furthermore, in the biodegradation type apparatus, the regulation of moisture is also an important factor for the effective activity of bio-organisms. For the apparatus in commercial use, since the size of the apparatus is large, an automatically controlled water sprinkling system or the like is commonly used for the purpose of moisture regulation. However, in household apparatuses, so as to avoid the apparatus from being complicated and high in price, such a moisture regulation device is ordinarily not provided.

Since excessive moisture has a deleterious effect on the activity of bio-organisms, water must be thoroughly removed from the garbage before the garbage is placed in the apparatus. If the garbage is excessively dried conversely, the bio-organisms will suspend activity. Accordingly, when the amount of moisture is excessive, the introduction of fresh garbage needs to be interrupted until the microorganisms recover their activity or function; while in a dry condition, an appropriate amount of moisture replenishment is required.

When the amount of moisture is excessive, or garbage that contains rice or noodles with a large moisture content or contains a large amount of oil is put in the apparatus, the supply of oxygen is cut off, and degradation becomes difficult (e.g., the chips and garbage form aggregate masses as a result of agitation, etc.), so that chip replacement that is troublesome and requires effort becomes unavoidable. Thus, experience and skill are required in order to use a biodegradation type treatment apparatus in a completely effective manner.

Most of the content of raw garbage is moisture; accordingly, a considerable reduction in volume and weight can be achieved merely by removing this separate moisture content by heating and agitating using a drying type treatment apparatus. In the case of a biodegradation system, it is also an object to reduce the amount of raw garbage by degrading the garbage into carbon dioxide gas and water, etc., by means of microorganisms. In actuality, however, as described above, some garbage cannot be degraded in a short time even if this garbage consists of organic matter, and inorganic matter that cannot be degraded in the first place remains. In cases where the above-described restrictions and regulations regarding the garbage that is placed in the apparatus are not observed, the amount of residue that exists in a rough form is increased even further. Thus, it is actually extremely difficult to smoothly achieve a continuous reduction in the amount of raw garbage.

As described above, the biodegradation system has a problem that a smooth treatment or disposing of the garbage is not continued when the regulation of the moisture content or the type, content, amount, etc. of the raw garbage that is placed in the apparatus are inappropriate (as described above). Thus, an amount of chips that exceeds over the amount actually required is ordinarily placed in the degradation tank beforehand. The amount of chips placed in the tank varies according to the treatment apparatus used but is ordinarily about 15 to 20 liters. One advantage of such a biodegradation system is that the garbage that has been subjected to a degradation treatment can be recycled to be used as fertilizer. In actuality, however, such treated garbage is usually set out as combustible garbage on collection days, and the amount of this combustible garbage increases by the addition of chips. Furthermore, special products must be used for the bio-organisms and chips.

In the drying system, there is no need for complicated control such as moisture control, etc. (as is the case in the biodegradation system); and chips are also unnecessary, and there is no need for experience in the use of the system. However, since the raw garbage is heated to a high temperature, the treatment tank needs to be a heat-resistant vessel that has an agitating apparatus (which also performs pulverization). Moreover, from the standpoint of convenience of use, it is desirable that the treatment tank be detachable. Furthermore, the exhaust gas of the volatilized moisture has a strong odor, so that an airtight apparatus and the installation of a deodorizing device such as a heating catalyst, etc. in the exhaust path are indispensable. As a result, the apparatus becomes complicated.

Raw garbage is placed in the apparatus whenever the garbage is generated (within the disposal capacity for one day) in the biodegradation system; however, in the drying system, when the cover is opened during the disposing process and heating, a strong odor escapes to the outside without passing through the deodorizing device. Accordingly, the next load of garbage must be placed in the apparatus after completing the heat treatment and waiting for the apparatus to cool. Consequently, it is necessary to shorten the treatment time; and it is, therefore, necessary to facilitate heating by reducing the volume of the treatment tank. As a result, the amount of garbage that is put in the treatment tank reduces. Furthermore, the amount of power consumption, which constitutes a running cost, tends to increase.

Furthermore, the apparatus disclosed in Japanese Patent Application Laid-Open (Kokai) No. 59-162957, which is a drying type apparatus, has the above-described problems that are common to drying systems. Moreover, since the cutter of the apparatus only cuts the raw garbage once at a time that the garbage is placed in the apparatus, it is difficult to pulverize the raw garbage to a sufficiently small size. In the case of the apparatus disclosed in Japanese Patent Application Laid-Open (Kokai) No. 2001-113194, though it appears that the raw garbage can be repeatedly introduced into the cutter while being scraped up by the helical inclined plate; however, since the cutter comprises only a single stage in the axial direction, it takes time to finely cut the raw garbage. Thus, the treatment efficiency is low.

SUMMARY OF THE INVENTION

The present invention was devised in light of the facts described above.

The first object of the present invention is to provide a raw garbage treatment or disposing apparatus which is subject to few restrictions on use compared to conventional biodegradation systems, which is easy to use with no need for experience or skill, which makes it possible to eliminate or reduce the amount of bio-chips used, which can increase the amount of raw garbage accommodated and also shorten the treatment time compared to conventional drying systems, and which simplifies the structure of the apparatus and is suitable for a reduction in size.

The second object of the present invention is to provide a cutter for cutting or pulverizing raw garbage that is suitable for use in a raw garbage treatment apparatus.

The above object is accomplished by a unique structure of the present invention for a raw garbage treatment apparatus that treats raw garbage while pulverizing the garbage by cutting the garbage; and in the present invention, the apparatus comprises:

- a substantially cylindrical treatment tank with a bottom thereof closed;
- a rotating shaft provided to rise from a center of a bottom plate of the treatment tank;
- a motor provided beneath the treatment tank and rotates the rotating shaft;
- a plurality of rotating blades each of which has cutting vanes that radially extend outward with the rotating shaft as a center, the rotating blades being fastened to the rotating shaft at intervals from each other in the axial direction of the rotating shaft;
- a plurality of fixed blades through which the rotating shaft rotatably passes and which form, together with the rotating blades, a main cutter; and
- a supporting frame which has vertical plates that hold outer ends of the fixed blades, the upper end of the supporting frame being fastened to the upper portion of the treatment tank.

In this structure, the rotating shaft can be detachable from the output shaft of the motor, so that the main cutter and supporting frame, etc. can be assembled on the rotating shaft beforehand to form an assembled body that is installed in the treatment tank, thus improving the assembly characteristics. It is desirable that that the upper portion of the rotating shaft be held by the supporting frame. For instance, the upper portions of the supporting frame's vertical plates that hold the plurality of fixed blades are connected by a top plate, so that this top plate supports the rotating shaft.

The present invention, however, includes a configuration in which the rotating shaft is firmly held at its lower portion on the bottom plate so as to avoid the upper portion of the rotating shaft from swinging. In this structure, the upper portion of the rotating shaft is not required to be held by the supporting frame. The fixed blade may have a single cutting vane; and thus since a single vertical plate is sufficient, only one supporting frame is required.

The rotating blades that are fastened to the rotating shaft are provided at equal intervals in the axial direction of the rotating shaft by way of using spacers in between. It can be possible to provide the rotating blades at unequal intervals. For example, one fixed blade can be provided so that two rotating blades make close contact with or slide on this fixed blade from above and below; and conversely, two fixed blades can be provided above and below so as to make close contact with or slide on a single rotating blade.

The rotating shaft takes a polygonal cross-sectional shape, e.g., a hexagonal shape, pentagonal shape, square shape, etc., so that the rotating blades can easily be fastened to the rotating shaft via engaging openings thereof formed to have a cross-sectional shape which is same as that of the rotating shaft. The rotating blades can be provided on the rotating shaft by other means. For instance, a groove that is long in the axial direction (key groove, etc.) or protruding teeth can be formed in the rotating shaft, or the rotating shaft can be formed as a spline shaft in which spline teeth are machined, so that the rotating blades are engaged with such a groove, protruding teeth or spline teeth.

The rotating blades and fixed blades are mounted on the rotating shaft from above in order with spacers or collars of appropriate dimensions interposed if necessary and are held on the rotating shaft by the screw engagement of bolts and nuts on the upper end of the rotating shaft. In this case, the fixed blades are assembled while successively engaging the outside portions (in the radial direction) of the blades with engaging openings formed in the vertical plates of the supporting frame prior to the screw engagement of the bolts and nuts. With the above assembling, a main cutter is formed with the rotating blades and fixed blades that are superimposed in a plurality of stages in the vertical direction (or in the axial direction of the rotating shaft).

An inclined plate used for upward and downward agitation of the garbage can be provided on a rotating base, which rotates together with the rotating shaft, between the supporting frame and the treatment tank in close proximity to the bottom plate of the treatment tank. With this inclined plate, the raw garbage that accumulates in the bottom of the treatment tank is repeatedly fed upward and introduced into the main cutter from above. Thus, the raw garbage is efficiently cut by the main cutter, providing an improved treatment efficiency of the garbage.

Furthermore, an arm member that has a substantially circular arc form shape (when seen from above) and rotates together with the inclined plate and feeds the raw garbage inward can be provided on the rotating base. With this structure having the arm member, the raw garbage is efficiently fed into the main cutter from the spaces between the vertical plates of the supporting frame, so that the raw garbage is cut even more efficiently, thus further improving the treatment efficiency of the garbage.

Furthermore, the rotating base can be designed so that a part thereof in the circumferential direction protrudes outward in the radial direction beyond the vertical plates of the supporting frame, thus forming a lower cutter together with a fixed base that is fastened to the bottom plate. Moreover, an upper rotating blade can be fastened to the upper end of the rotating shaft, thus forming an upper cutter by this upper rotating blade and the supporting frame and/or an upper fixed blade held on the supporting frame. The treatment efficiency of the garbage greatly improves by such a lower cutter and upper cutter.

It is desirable that the temperature of the garbage during the treatment or disposing process be maintained at an appropriate temperature by a heater provided near the bottom of the treatment tank, e.g., on the bottom plate or in the lower portion of a cylindrical member of the treatment tank, etc. Moreover, an exhaust fan can be installed in the treatment tank. With an exhaust fan, the vapor generated from the raw garbage inside the treatment tank is efficiently exhausted, so that the drying of the raw garbage is accelerated.

The above object is accomplished by a unique structure of the present invention for a cutter or a cutter assembly that is used in a raw garbage treatment apparatus that processes raw garbage while pulverizing the garbage; and in the present invention, the cutter comprises:

- a rotating shaft which is provided in a vertical attitude and is rotationally driven by an electric motor,
- a plurality of rotating blades each of which has cutting vanes that radially extend outward with the rotating shaft as a center, the rotating blades being fastened to the rotating shaft with spaces in between in an axial direction of the rotating shaft,
- a supporting frame which has vertical plates that are provided so as not in touch with the outer ends of the rotating blades, and
- a plurality of fixed blades each of which having cutting vanes that radially extend outward and tip ends of the cutting vanes being held by the vertical plates of the supporting frame, the rotating shaft passing through the fixed blades so that the rotation of the rotating shaft is not hindered; and the cutter cuts raw garbage in multiple stages while causing the raw garbage to fall downward between the cutting vanes of the rotating blades and fixed blades.

The raw garbage treatment apparatus of the present invention is usable in either a biodegradation system or a drying system.

In cases where the apparatus is used in a biodegradation system, the raw garbage and bio-chips are placed in the treatment tank at an appropriate mixture ratio. In cases where the apparatus is used in a drying system, the raw garbage is placed in the treatment tank without bio-chips. With a small quantity of bio-chips used in the biodegradation system, the characteristics as a drying system become more pronounced; however, the extent of fluctuations in the treatment efficiency of the garbage are small compared to a conventional biodegradation system. Accordingly, there is a large degree of freedom in the quantity of bio-chips mixed with raw garbage.

The raw garbage put in the treatment tank is finely cut in multiple stages by the main cutter that is formed by a plurality of rotating blades and a plurality of fixed blades which are provided in multiple tiers in the vertical direction. Since the outward movement of the raw garbage in the radial direction is restricted by the vertical plates that hold the outer ends of the fixed blades, the escape of the raw garbage from the main cutter is prevented, and the cutting of the raw garbage is reliably performed.

Since the raw garbage is thus finely cut (or cut and pulverized), a reduction in the volume and quantity of the raw garbage is promoted.

Furthermore, when the treatment tank is heated by the heater, drying of the raw garbage is promoted since the raw garbage is heated. In this case, by way of controlling the heating so that the raw garbage is heated to a temperature that does not result in the generation of a strong odor, a strong odor that is a drawback of the drying system is suppressed. The convenience of use can be improved by setting this temperature at one that allows raw garbage to be treated in a one-day (24-hour) cycle.

When the exhaust fan is installed and operated, outside air is brought into the interior of the treatment tank. However, this introduction of outside air is not performed only for the purpose of supplying oxygen to the bio-organisms, but also for the purpose of promoting drying of the garbage by using the exhaust to cause the vapor-form moisture generated from the finely pulverized and heated raw garbage to escape to the outside of the treatment tank.

The raw garbage treated by cutters and has been degraded and pulverized is taken out of the treatment tank when the process completes. The treated garbage is utilized as fertilizer, etc.

DETAILED DESCRIPTION OF THE INVENTION

Figure 1:
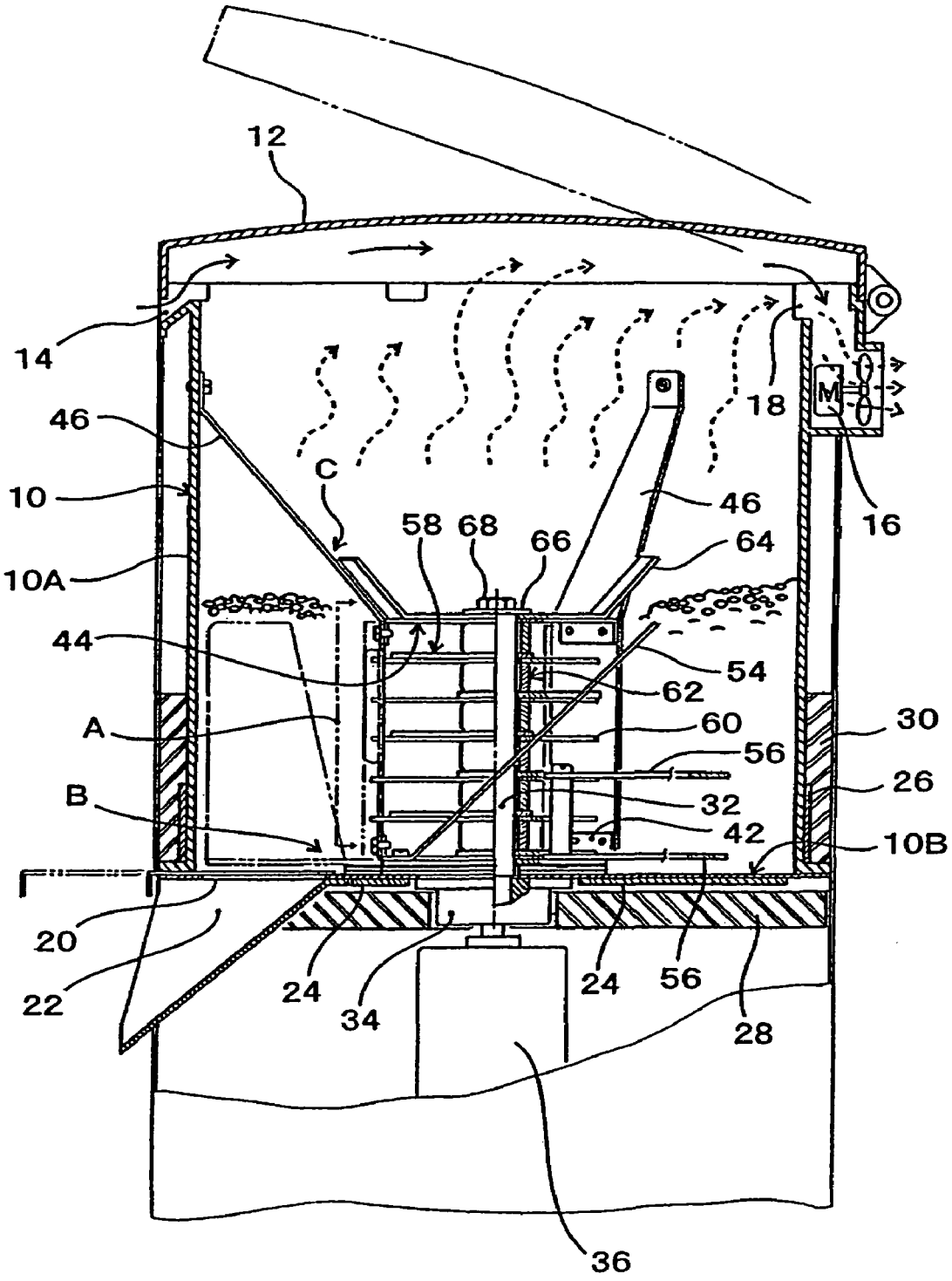
FIG. 1 is a sectional side view of the raw garbage treatment apparatus according to one embodiment of the present invention.
Figure 2:
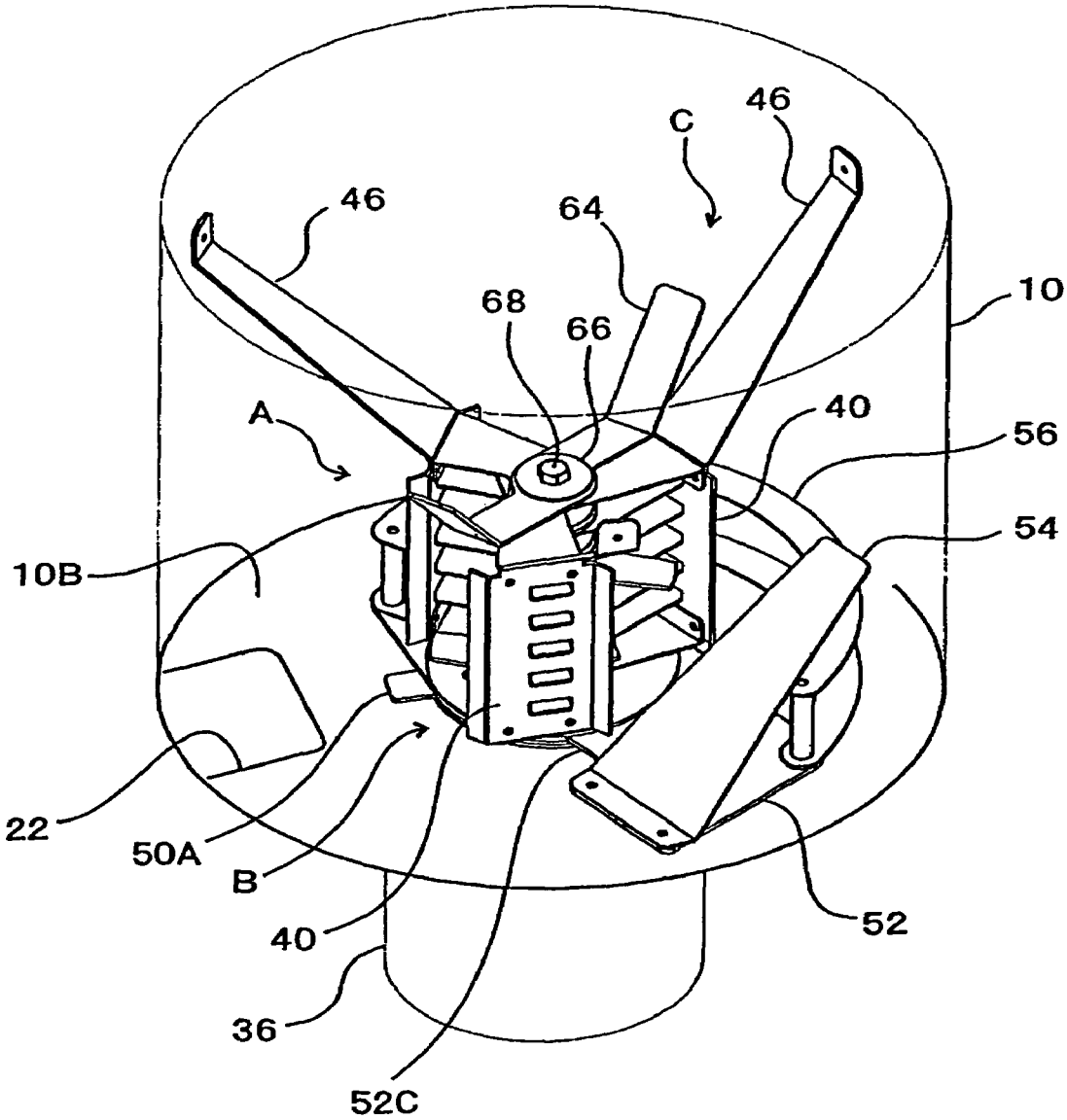
FIG. 2 is a perspective view of the internal structure of the same.
Figure 5:
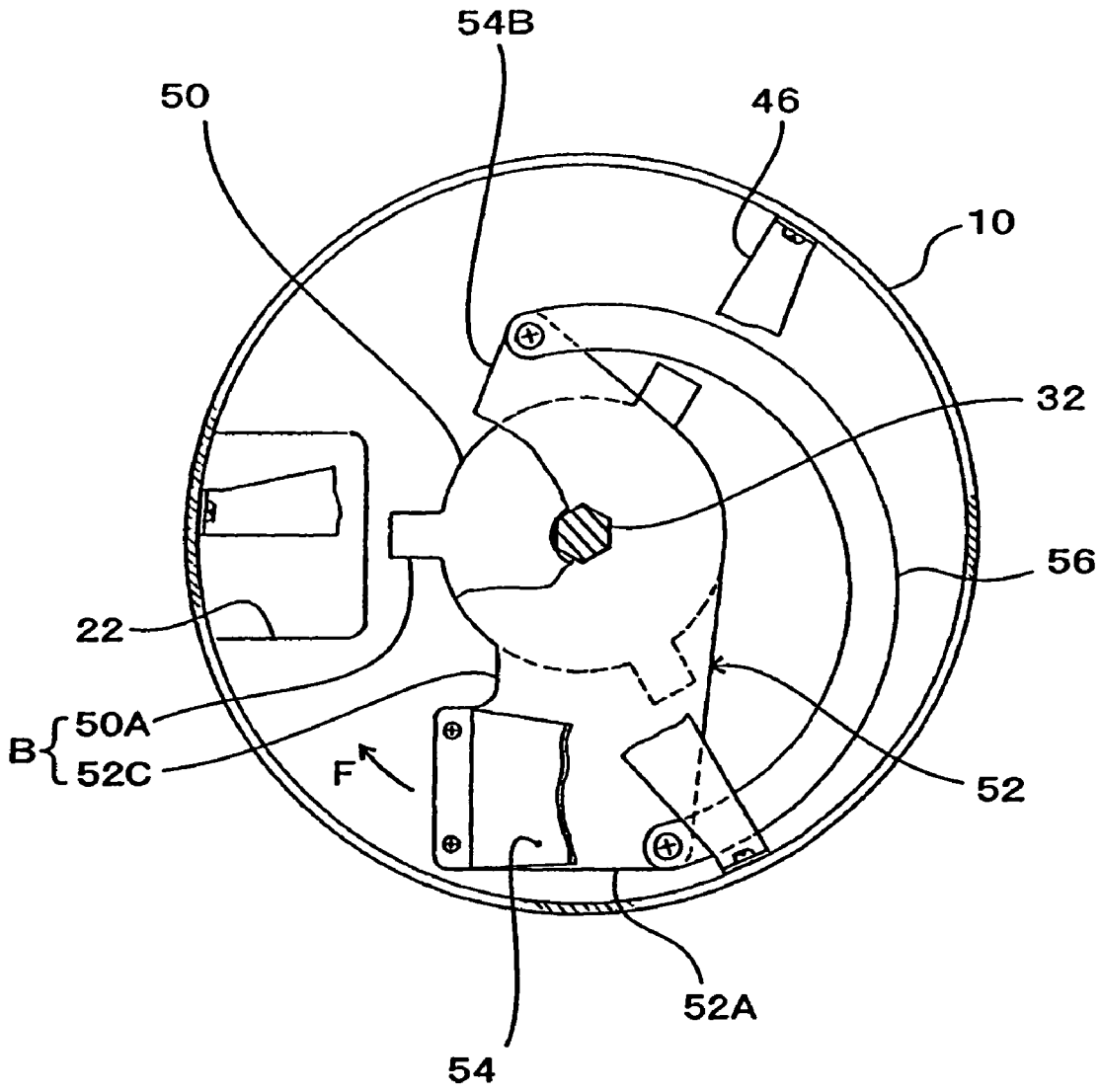
FIG. 5 is a plan view of the area near the bottom of the treatment tank, showing the inclined plate, arm members and lower cutter.
Figure 6:
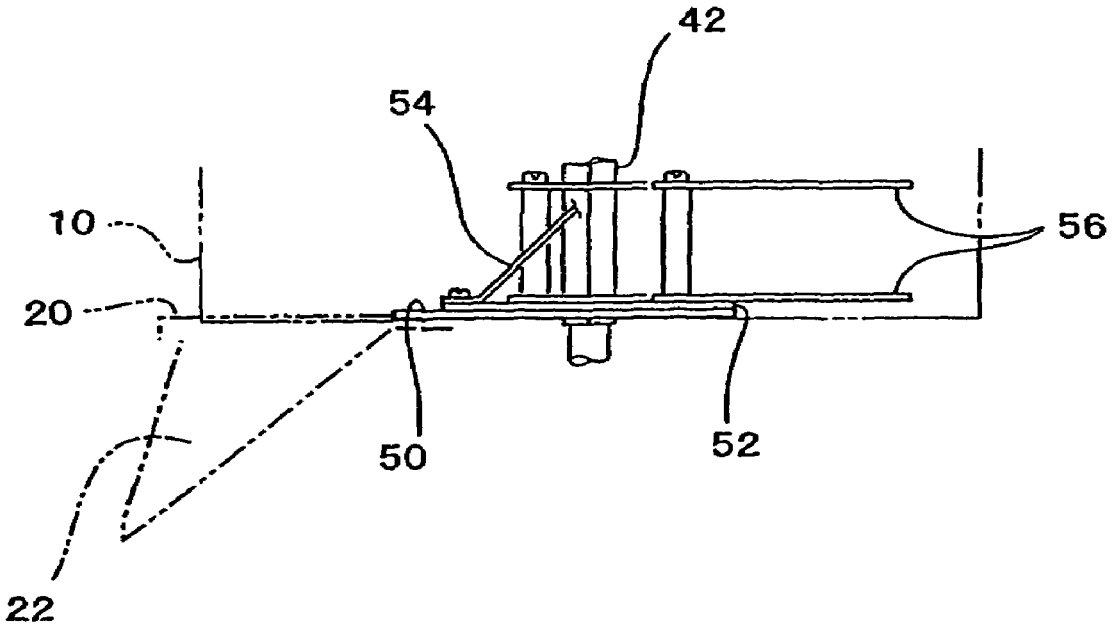
FIG. 6 is a sectional side view of the same.

In FIGS. 1, 2 and 5, the reference numeral 10 indicates a cylindrical treatment tank which has a closed bottom. In the shown treatment tank, the bottom of the cylindrical section 10A is closed off by a bottom plate 10B, and a cover plate 12 is attached to the opening which is in the upper end portion of the cylindrical section 10A so that the cover plate 12 is opened and closed. The bottom plate 10B is made of a metal that is superior in terms of thermal conductivity, such as a stainless steel plate, etc. It is desirable that the cylindrical section 10A also be made of a similar material to that of the bottom plate 10B.

An intake opening 14 that admits outside air is provided in the upper portion of the treatment tank 10, and so are the exhaust fan 16 and exhaust passage 18 which are used to exhaust the vapor generated from the raw garbage. The draft of the exhaust fan 16 is set so that the vapor from the raw garbage does not condense inside the treatment tank 10. A catalyst used for deodorization can be set in the exhaust passage 18.

A part of the bottom plate 10B is opened and closed by a shutter 20, and a garbage disposal opening 22 for discharging the treated garbage is provided so as to face the shutter 20.

Electric heaters 24 and 26 for heating the interior of the treatment tank 10 are attached so that the heaters are in contact tightly with the undersurface of the bottom plate 10B and the outer circumferential surface of the lower portion of the cylindrical section 10A. The bottom of the heater 24 and the outer circumference of the heater 26 are covered by adiabatic materials 28 and 30 so as to improve the heat retention characteristics.

Next, the cutter provided inside the treatment tank 10 will be described.

The cutter or a cutter assembly is comprised of a main cutter A which is formed in multiple tiers of blades in the vertical direction, a lower cutter B which is provided beneath the main cutter A, and an upper cutter C which is provided above the main cutter A.

These cutters A, B and C are driven by a rotating shaft 32 that has a hexagonal cross-sectional shape that rises in an upright attitude from the center of the bottom plate 10B. The lower end of the rotating shaft 32 is supported on a bearing 34 and is connected to the output shaft (not shown) of an electric motor 36 which is installed under the treatment tank 10. The motor 36 has a speed reduction mechanism, so that the rotating shaft 32 rotates relatively slowly. The rotating shaft 32 is detachable with respect to the output shaft of the motor 36. The rotating shaft 32 can be detachably connected to an output shaft of a speed reduction device (not shown) that is connected a motor 36 that is without a speed reduction mechanism.

With the rotating shaft 32 separated (or pulled out) from the bearing 34, a supporting frame 36 and rotating blades 58, fixed blades 60, etc. (described below) are assembled on the rotating shaft 32, and this assembled body is installed inside the treatment tank 10.

As is clear from FIG. 2, the supporting frame 38 comprises three vertical plates 40 that are positioned on three non-adjacent sides of an imaginary substantially hexagonal shape (when viewed from above or in a plan view), a lower plate 42 and upper plate 44 (see FIG. 3) each having three radial supporting arms that are respectively fastened to the lower ends and upper ends of the vertical plate 40, and connecting arms 46 that extend outward and upward at an inclination from the upper ends of the vertical plates 40. The rotating shaft 32 passes through the lower plate 42 and upper plate 44 so that the rotating shaft 32 is free to rotate. The upper ends of the connecting arms 46 are fastened by screws to the upper inner surface of the treatment tank 10 after the above-described assembly is completed.

As best seen from FIG. 3, a plurality of engaging openings 48 with which the outer ends of the fixed blades 60 (described below) engaged are formed in the vertical plates 40 at an appropriate spacing in the vertical direction. The (three) outer ends of the respective lower plate 42 and upper plate 44 are bent at right angles, and these bent portions are fastened by screws to the vertical plates 40. In the actual assembly, the rotating blades 58 (described below) and fixed blades 60 are provided on the rotating shaft 32 in a manner that these blades are (spacedly) sandwiched between the lower plate 42 and upper plate 44, and the vertical plates 40 are fastened by screws to the lower plate 42 and upper plate 44 with the outer ends of the fixed blades 60 engaged with the engaging openings 48 of the vertical plates 40.

Separately from the assembly of the supporting frame 38, a fixed base 50 is fastened by screws to the center of the bottom plate 10B of the treatment tank 10, and a rotating base 52 is set on top of the bottom plate 10B. The rotating base 52 can be provided on the lower portion of the rotating shaft 32.

As seen from FIGS. 2 and 5, the fixed base 50 is a circular plate, and it has a diameter substantially the same as that of an imaginary circle inscribing the three vertical plates 40. The fixed base 50 is formed with three projections 50A that protrude outwardly from the circumferential edge of the fixed base 50 at equal intervals. The rotating base 52 has protruding portions 52A and 52B that protrude in substantially the diagonal direction from a circular plate of the same diameter as that of the fixed base 50. The rotating base 52 is engaged with the rotating shaft 32 and rotated thereby.

To the protruding portions 52A of the rotating base 52, an inclined plate 54 is fastened at its lower end (front end with reference to a rotational direction thereof). The inclined plate 54 is provided so as to gradually become higher in the direction opposite to the rotational direction of the rotating shaft 32 outside (with respect to the radial direction) the vertical plates 40 of the supporting frame 38. In other words, the inclined plate 54 is in the space between the vertical plates 40 and the inner surface of the treatment tank 10. As will be described below, the inclined plate 54 has an agitating effect in the vertical direction of the treatment tank 10 so that it lifts the raw garbage inside the treatment tank 10 upward and agitates the raw garbage.

Furthermore, two arm members 56 (upper and lower arm members) which are held spacedly from each other in the vertical direction are attached to the rotating base 52. These arm members 56 are in a substantially circular arc shape (when seen from the top or in a plan view as best seen from FIG. 5). The arm members 56 are fixed at its one end (front end with reference to the rotational direction F of the rotating shaft 32 or the rotating base 52) to the protruding portion 52A of the rotating base 52 and at its other end (rear end) to the protruding portion 52B of rotating base 52. As seen from FIG. 5, the arm members 56 bend inwardly and it gradually gets closer to the center of the treatment tank 10 (i.e., toward the vertical plates 40 of the supporting frame 38) in the direction opposite to the rotational direction F of the rotating shaft 32 or the rotating base 52, such direction being the counter-clock direction in FIG. 5. These arm members 56 have an agitating effect so that they cause the raw garbage to move inward as the arm members 56 are rotated.

The leading edge 52C (in the direction of rotation F) of the protruding portion 52A of the rotating base 52 cuts the raw garbage when this leading edge 52C passes over the projections 50A of the fixed base 50 in close contact to these projections 50A. Thus, the fixed base 50 and the rotating base 52 form a lower cutter B with their projection 50A and protruding portion 52A.

The main cutter A comprises a plurality of rotating blades 58 and a plurality of fixed blades 60 that are provided on the rotating shaft 32. The outer ends in the radial direction of the fixed blades 60 are, as described above, connected to the vertical plates 40 of the supporting frame 38. Each one of the rotating blades 58 has one cutting vane 58A that extends outwardly as seen from FIG. 4. Each of the fixed blades 60 has three radially oriented cutting vanes 60A as seen from FIG. 3. The rotating blades 58 are respectively provided with openings that have the same shape as the cross section of the rotating shaft 32, and the rotating shaft 32 is passed through these openings, so that the rotating blades 58 are fastened to the rotating shaft 32 and rotated when the rotating shaft 32 rotates. The fixed blades 60 are respectively provided with openings that have different shape (such as round) from the cross section of the rotating shaft 32, and the rotating shaft 32 is passed through these openings, so that the fixed blades 60 are circumferentially loose on the rotating shaft 32 and thus not rotated when the rotating shaft 32 rotates.

Figure 4:
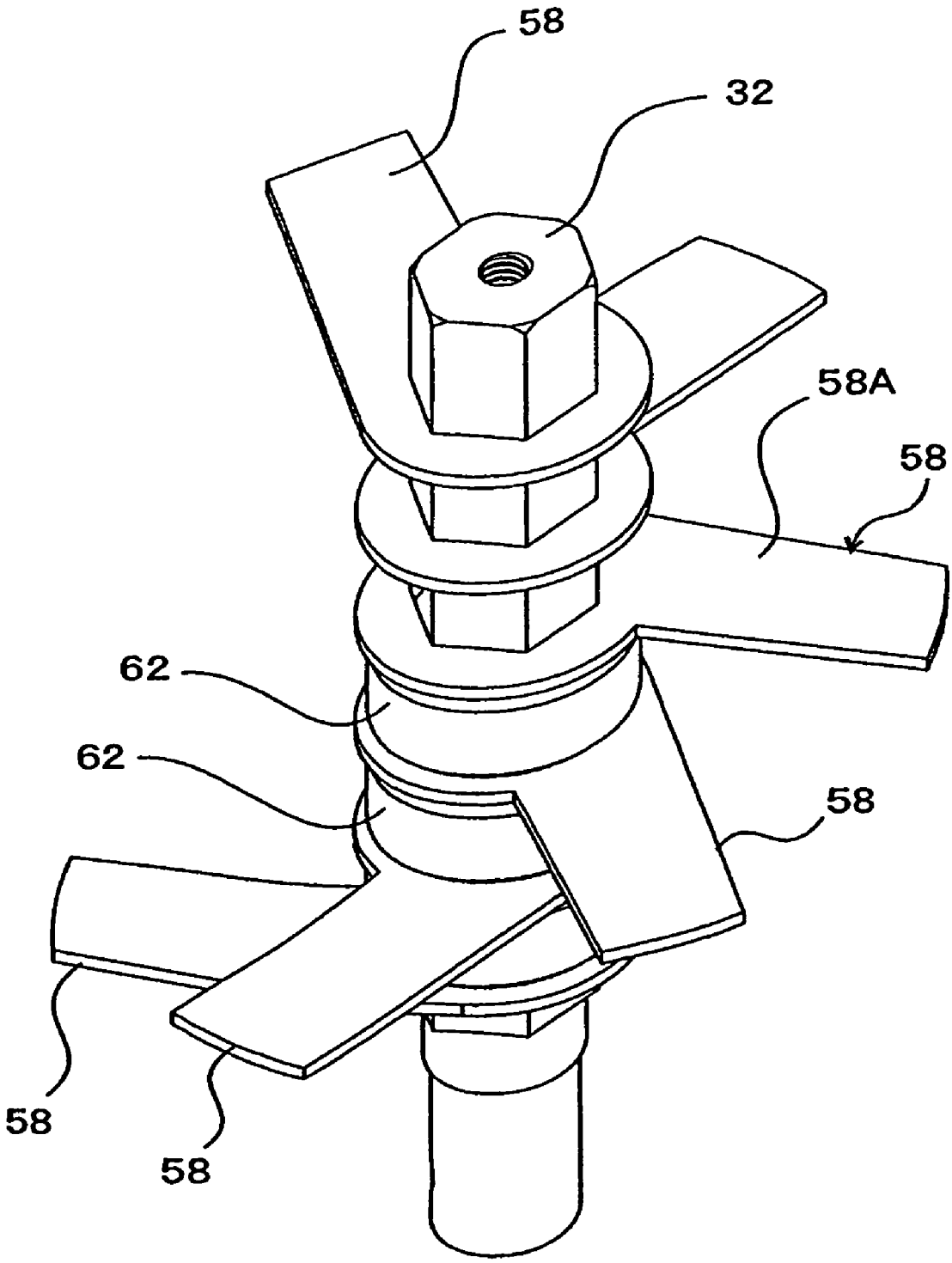
FIG. 4 is a perspective view of the rotating blades of the main cutter.

The plurality of rotating blades 58 are provided on the rotating shaft 32 with constant spacing from each other by interposing collars 62 that constitute spacers as shown in FIG. 4. In FIG. 4, some of the collars are omitted. In regard to the angles between the plurality of rotating blades 58 in the rotational direction of the rotating shaft 32, such blades are provided in a spiral configuration in which the attachment angles of the blades are successively displaced in the direction opposite from the rotational direction of the rotating shaft 32 (at intervals of 60°) from the bottom as shown in FIG. 4.

The arrangement of the rotating blades 48 can be altered in accordance with the type of garbage, etc.

Figure 8:
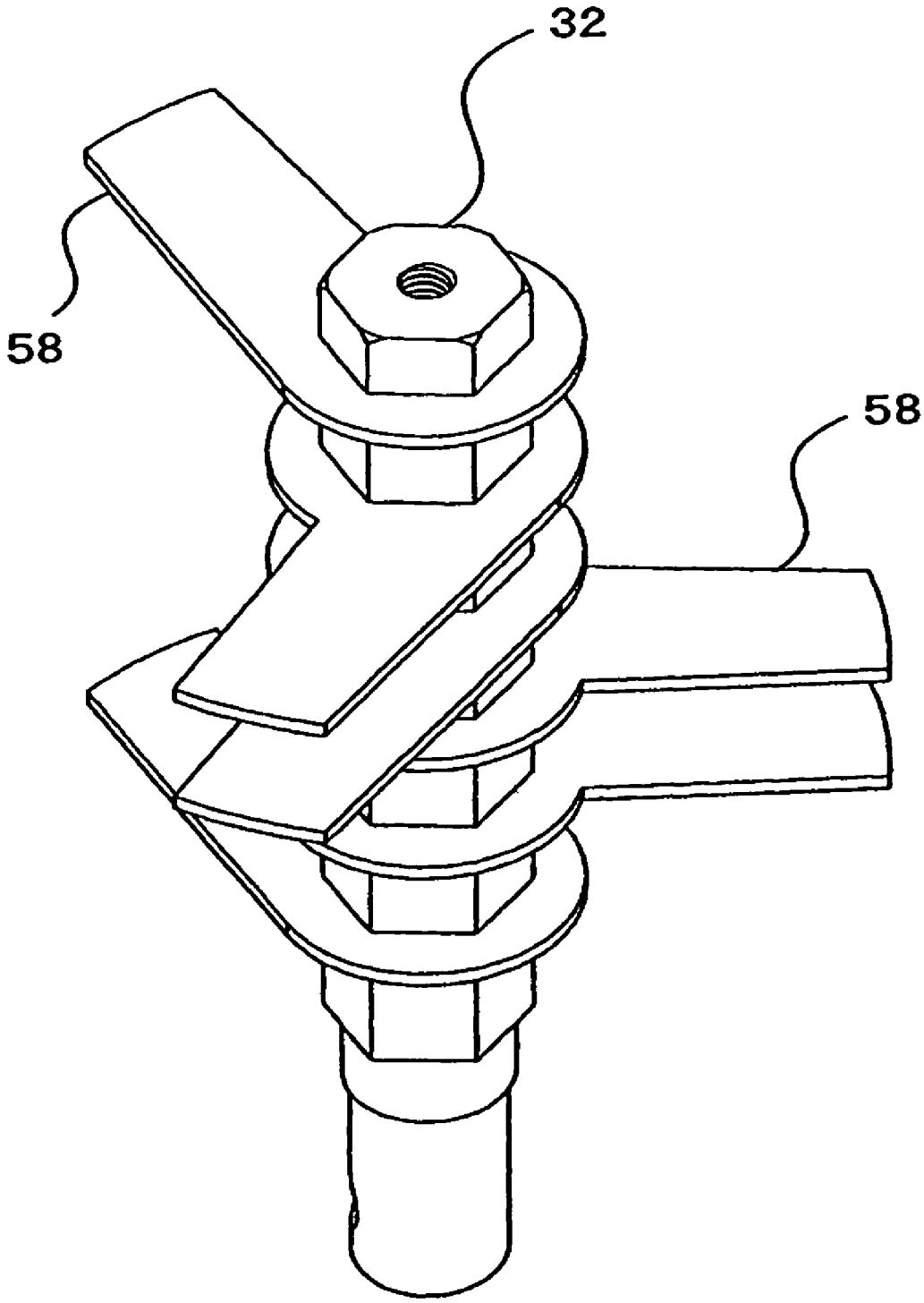
FIG. 8 is a perspective view showing another type of rotating blades of the main cutter.

FIG. 8 shows an example of arrangement of the rotating blades different from the one shown above. In this example of FIG. 8, the rotating blades 58 are arranged in a non-spiral configuration, i.e., in an arbitrary (random) configuration. In FIG. 8, collars (referred by the reference numeral 62 in FIG. 4) for securing the spacing between the rotating blades 58 are not shown.

Figure 3:
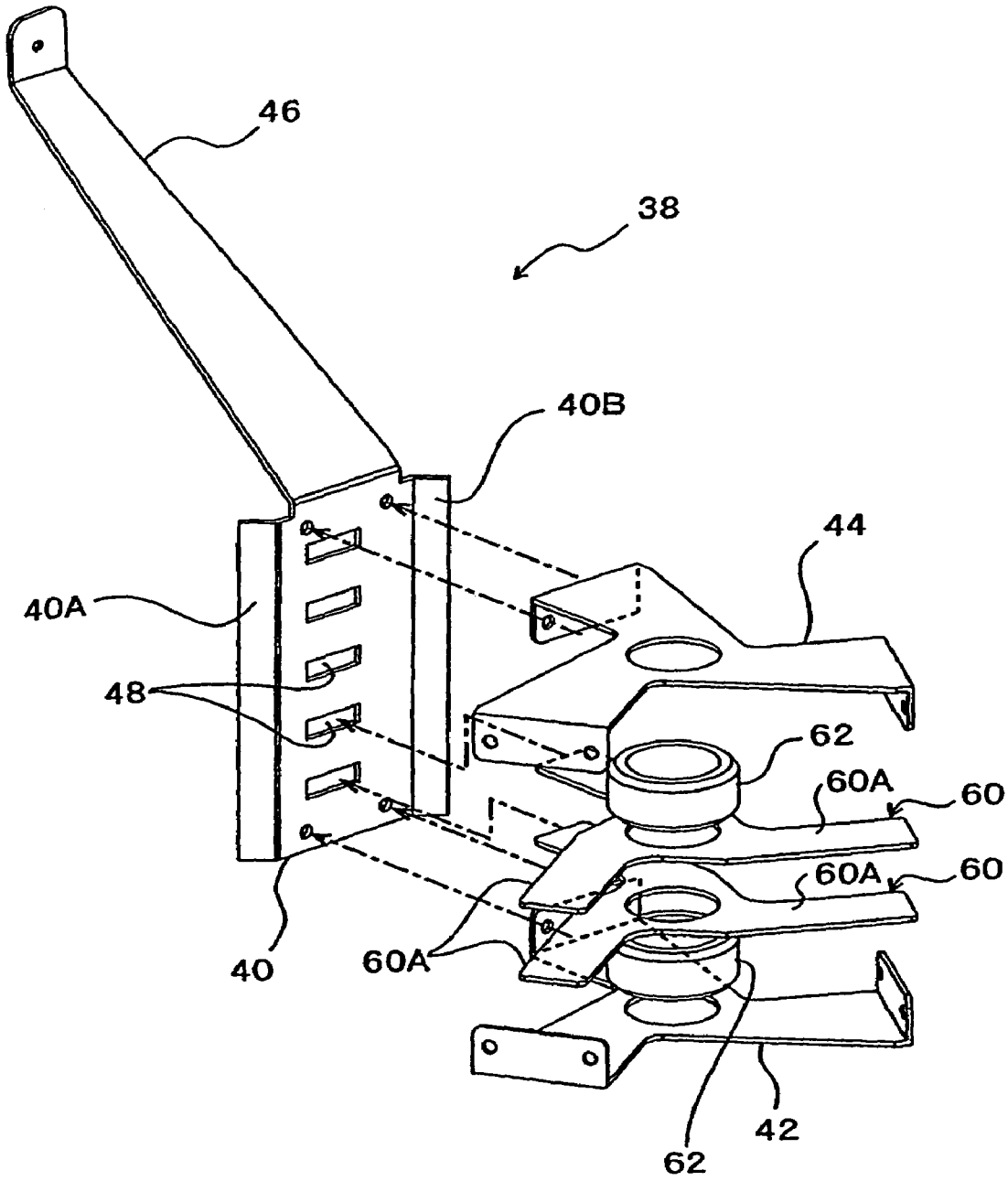
FIG. 3 is an exploded perspective view of the main cutter with a part thereof omitted.

The fixed blades 60 are provided, as shown in FIG. 3, on the rotating shaft 32, together with the rotating blades 58, with the collars 62 interposed. More specifically, as seen from FIG. 1, in the shown embodiment, five pairs of rotating blades 58 and fixed blades 60 are provided, and each rotating blade 58 makes contact with and slides on each fixed blade 60 when the rotating shaft 32 rotates to cut the raw garbage.

The lower plate 42 and the upper plate 44 are fastened to the vertical plates 40 while the fixed blades 60 are engaged, at their outer ends, with the vertical plates 40 as described above.

The vertical plates 40 of the above-described supporting frame 38 are provided outside of the outer ends of the rotating blades 58 in the radial direction thereof about the rotating shaft, so that the vertical plates 40 are prevented from touching the outer ends of the rotating blades 58, thus not hindering the rotation of the rotating blades 58.

After the rotating blades 58, fixed blades 60 and supporting frame 38, etc. are assembled or in parallel with this assembling, the upper cutter C is installed on the upper end of the rotating shaft 32.

Figure 7:
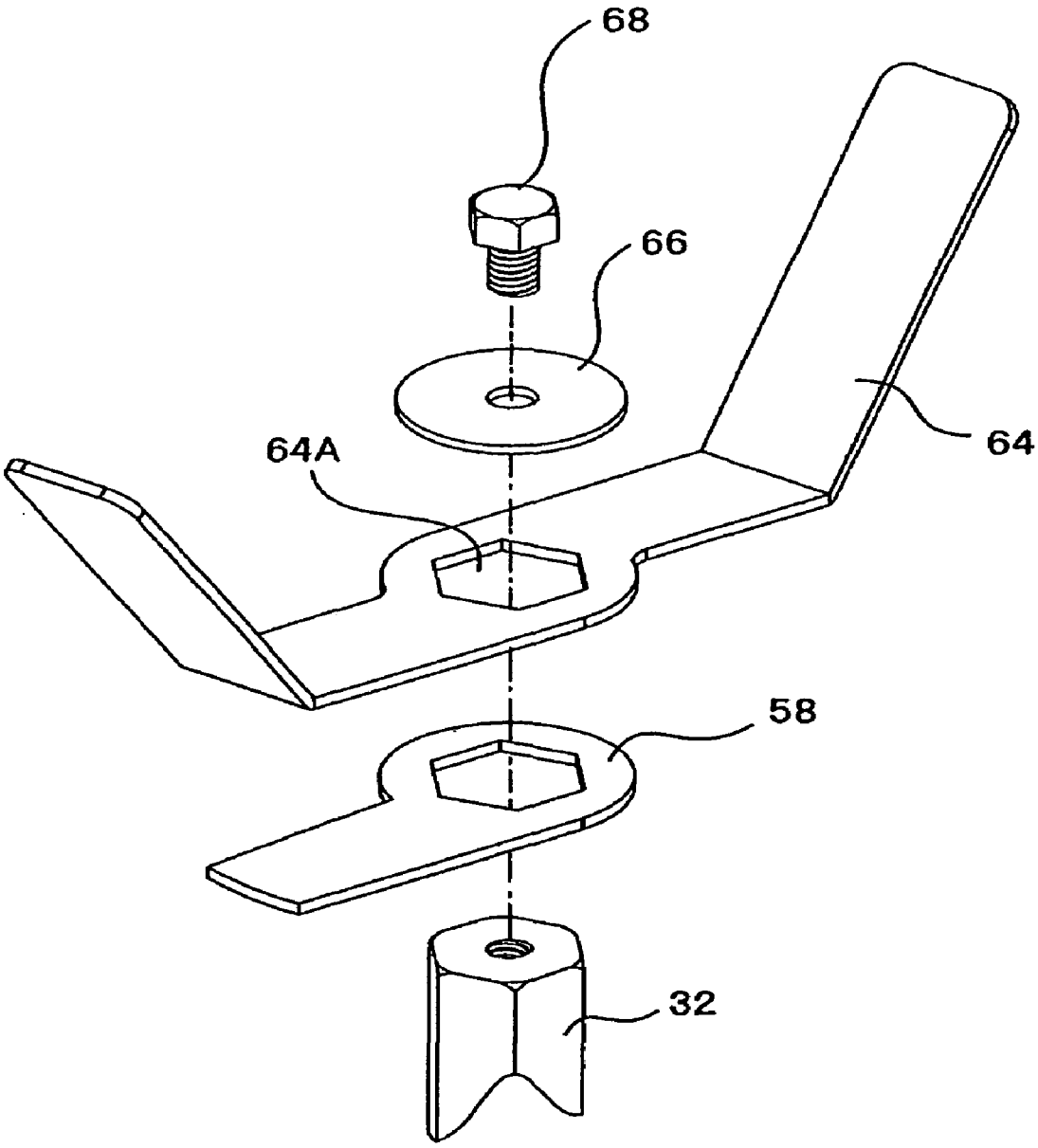
FIG. 7 illustrates the upper rotating blade of the upper cutter.

As shown in FIGS. 1, 2 and 7, the upper cutter C is comprised of an upper rotating blade 64 which is fastened to the upper end of the rotating shaft 32, the upper plate 44 constituting an upper fixed blade that forms a part of the supporting frame 38, and the connecting arms 46. The upper rotating blade 64 extends, as seen from FIG. 2, outward from the center in the radial direction along the upper plate 44, and the tip end portions of this blade 64 are bent upward at an inclination that the tip end portions run along the connecting arms 46.

Furthermore, as is clear from FIG. 7, the upper rotating blade 64 engages with the rotating shaft 32 via its hexagonal hole 64A and is fastened to the rotating shaft 32 by a bolt 68 with a washer 66 in contact with the top end surface of the rotating shaft 32. As a result, the upper rotating blade 64 is securely engaged with the hexagonal outer circumferential surface of the rotating shaft 32. The washer 66 acts also to prevent any function drop of the cutter that might be caused when the upper rotating blade 64 is deformed upward by hard garbage fragments or when the gap between the upper plate 44 and the connecting arms 46 increases.

Following the assembly of the cutter in the manner described above, the rotating base 52 of the lower cutter C is provided on the lower end of the rotating shaft 32. Then, the entire assembly is installed inside the treatment tank 10. In other words, the lower end of the rotating shaft 32 is connected to the output shaft of the motor 36 via the bearing 34, and the connecting arms 46 of the supporting frame 38 are attached to the upper inner surface of the treatment tank 10 by screws.

As seen from FIG. 3, one side edge or the edge portion 40A of each one of the three vertical plates 40 is bent outward in the form of a rib, and another side edge of the vertical plate 40 which is the edge portion 40B is bent inward in the form of a rib. In other words, the upper stream side edge (40A) of the vertical plate 40 with respect to the rotational direction of the rotating shaft 32 is bent outward or toward the inner surface of the treatment tank 10, and the down stream side edge (40B) of the vertical plate 40 with respect to the rotational direction of the rotating shaft 32 is bent inward or opposite from the inner surface of the treatment tank. Besides increasing the rigidity of the vertical plates 40 and thus increasing the bending strength, these bent edge portions 40A and 40B promote the cutting of the raw garbage. In other words, the edge portions 40A direct the garbage into the area surrounded by three vertical plates 40 and cause cutting by the main cutter A to be performed smoothly. The vertical plates 40 prevent the garbage from escaping out of the spaces between the rotating blades 58 and fixed blade 60.

The connecting arms 46 of the supporting frame 38 are formed so as to gradually rise outward toward the upper inner surface of the treatment tank 10. This shape makes it less likely that the raw garbage put in the treatment tank 10 are caught by the arms and that the raw garbage pushed upward by the inclined plate 54 comes into contact with the arms, thus accomplishing smooth agitation of the raw garbage in the vertical direction in the treatment tank 10.

Next, the operation of the above described treatment apparatus will be described.

Raw garbage is placed in the treatment tank 10, and bio-chips are also placed in the tank as necessary in accordance with the type of garbage. Then, the electric heater 24 and motor 36 are turned on. The heater 24 automatically controls the temperature inside the treatment tank 10 to an appropriate temperature using its temperature sensor.

The motor 36 rotates the rotating shaft 32 in the clockwise direction (as indicated by arrow F) in FIG. 5. The motor 36, however, is automatically controlled so that it rotates in reverse for a short period of time at appropriate time intervals, thus preventing garbage of long fibers from becoming entangled with the cutter, and preventing hard garbage from becoming concentrated on portions of the blades.

Large pieces of raw garbage are cut by the upper cutter C, and small pieces of raw garbage drop directly into the area inside the supporting frame 38 or an area surrounded by the vertical plates 40 of the supporting frame 38. In other words, small garbage and those cut by the upper cutter C enter the main cutter A by passing through the spaces between the radial arms of the upper plate 44 of the supporting frame 38 and is finely cut by the main cutter A while successively dropping through the cutter A constructed in multiple tiers by the rotating and fixed blades 58 and 60.

The raw garbage cut by the main cutter A goes out of the supporting frame 38 and reaches the bottom plate 10B of the treatment tank 10. Since the inclined plate 54 is caused to rotate on this bottom plate 10B by the rotating base 52 which is rotated by the rotating shaft 32, the raw garbage is pushed upward by this inclined plate 54; and a part of the garbage falls inward and is dropped onto the main cutter A. Furthermore, the circular arc form arm members 56 attached to the rotating base 52 feed the raw garbage in the direction toward the rotating shaft 32 and conduct the garbage into the main cutter A. Accordingly, the cutting by the main cutter A is done smoothly, and fine division and pulverization of the garbage are promoted.

Furthermore, the raw garbage cut by the main cutter A and dropped on the bottom plate 10B is further cut by the lower cutter B, so that cutting of the raw garbage is promoted to an even greater extent. While garbage is thus being treated, the exhaust fan 16 is operated, so that the discharge of water vapor out of the treatment tank 10 is continued.

As seen from the above, in the shown embodiment, since not only the main cutter A but also the upper cutter C and lower cutter B are provided, fine pulverization of the raw garbage is reliably accomplished. Furthermore, the inclined plate 54 agitates the raw garbage in the vertical direction, and the arm members 56 make agitation of the garbage in the inward direction. Accordingly, the raw garbage as a whole is pulverized in a smooth and uniform manner.

After the raw garbage is treated sufficiently, the motor 36 and heater 24 are stopped. Then, by pulling the shutter 20 out after waiting for the treated garbage to cool, the treated garbage is discharged to the outside through the garbage disposal opening 22. This discharge of the treated garbage can be smoothly accomplished when the motor 36 is turned on.

As seen from the above, in the present invention, the main cutter is formed in multiple tiers in the vertical direction by a plurality of fixed blades, which are provided on the rotating shaft in the axial direction and connected to the vertical plates of the supporting frame, and a plurality of rotating blades, which are provided on the rotating shaft in its axial direction. Accordingly, raw garbage is pulverized in a short period of time and in an efficient manner by these rotating blades, and the evaporation and dissipation of moisture is promoted. Consequently, sufficient drying is achieved even at a relatively low temperature.

Furthermore, by using bio-chips in combination with the apparatus of the present invention, it is possible to use the apparatus as a biodegradation type garbage treating apparatus. In this case, even if large pieces of raw garbage and/or hard raw garbage is placed in the treatment tank, since such raw garbage can be pulverized in a reliable manner, there are no bothersome restrictions on the conditions of use as there are in a conventional biodegradation system. The apparatus can be used easily with no need for experience or skill. Moreover, since fine division of the raw garbage is assuredly accomplished, the volume and weight of the garbage are reduced greatly. Accordingly, more amount of raw garbage than existing treatment apparatuses can be placed in the apparatus of the present invention, so that the size of the treatment tank is reduced in relative terms. There is no need for a moisture adjustment device in the apparatus of the present invention, and a deodorizing device is either unnecessary or can be simplified. Thus, the apparatus is simple in structure, and it is small in size.

In addition, the cutter (or cutter assembly) of the present invention is superior in cutting and pulverizing the raw garbage in the above described treatment apparatus.

What is claimed is:

1. A raw garbage treatment apparatus which treats raw garbage to dispose while cutting the raw garbage, the apparatus comprising:

a substantially cylindrical treatment tank with a bottom thereof closed, a rotating shaft provided to rise from a center of a bottom plate of said treatment tank, a motor which is provided beneath said treatment tank and rotates said rotating shaft, a plurality of rotating blades each of which has cutting vanes that radially extend outward with said rotating shaft as a center, said rotating blades being fastened to said rotating shaft at intervals from each other in an axial direction of said rotating shaft, a plurality of fixed blades through which said rotating shaft rotatably passes and which form a main cutter together with said rotating blades, and a supporting frame which has vertical plates that hold outer ends of said fixed blades, an upper end of said supporting frame being fastened to an inner upper portion of the treatment tank.

2. The raw garbage treatment apparatus according to claim 1, wherein said rotating shaft is detachable from an output shaft of the motor, and an upper portion of said rotating shaft is held by a top plate that is fastened to the supporting frame.

3. The raw garbage treatment apparatus according to claim 1, further comprising:

a rotating base which is fastened to said rotating shaft in close proximity to said bottom plate of the treatment tank, at least a portion of an outer circumference of said rotating base radially protruding further outward than the vertical plates of said supporting frame, and an inclined plate fastened to said rotating base, said inclined plate being provided on an outside of said vertical plates and inclined so as to become gradually higher outwardly so as to be used for upward and downward agitation of said raw garbage.

4. The raw garbage treatment apparatus according to claim 3, further comprising an arm member fastened to said rotating base and formed in, when seen in a plan view, a substantially circular arc shape so that one end said arm member is closer to said vertical plates of said supporting frame than another end thereof with respect to a direction opposite from a rotational direction of said rotating shaft.

5. The raw garbage treatment apparatus according to claim 3, further comprising a fixed base which is fastened to said bottom plate in close proximity to an undersurface of said rotating base, thus forming a lower cutter together with said rotating base, said fixed base having projections projecting outwardly.

6. The raw garbage treatment apparatus according to claim 3, wherein an upper rotating blade that radially extends outward from the rotating shaft is provided on an upper end of said rotating shaft, and said upper rotating blade forms an upper cutter together with said supporting frame and an upper fixed blade which is held by the supporting frame.

7. The raw garbage treatment apparatus according to claim 1, further comprising a heating means provided at a lower portion of the treatment tank.

8. The raw garbage treatment apparatus according to claim 1, further comprising a ventilation means provided at a higher portion of the treatment tank.

9. A cutter used in treating raw garbage for cutting and pulverizing raw garbage, comprising:

a rotating shaft which is provided in a vertical attitude and is rotationally driven by an electric motor, a plurality of rotating blades each of which has cutting vanes that radially extend outward with said rotating shaft as a center, said rotating blades being fastened to said rotating shaft at intervals from each other in an axial direction of said rotating shaft, a supporting frame which has vertical plates that are provided outside of outer ends of said plurality of rotating blades in a radial direction about said rotating shaft so as to refrain from touching said plurality of rotating blades, and a plurality of fixed blades each of which has cutting vanes that radially extend outward with tip ends thereof being held on said vertical plates, said rotating shaft rotatably passing through said fixed blades.

* * * * *